US005125448A

United States Patent [19]

Jensen

[11] Patent Number: 5,125,448

[45] Date of Patent: * Jun. 30, 1992

[54] AUTOMATIC FOUNDRY PLANT

[75] Inventor: Kaj J. Jensen, Lyngby, Denmark

[73] Assignee: Dansk Industri Syndikat/AS, Denmark

[ * ] Notice: The portion of the term of this patent subsequent to Oct. 8, 2008 has been disclaimed.

[21] Appl. No.: 742,229

[22] Filed: Aug. 7, 1991

Related U.S. Application Data

[63] Continuation of Ser. No. 525,705, May 21, 1990, abandoned.

[30] Foreign Application Priority Data

May 19, 1939 [DK] Denmark ..... 2452/89

[51] Int. Cl.[5] ..... B22D 47/02; B22D 2/00

[52] U.S. Cl. ..... 164/155; 164/457; 164/167; 164/323

[58] Field of Search ..... 164/456, 457, 458, 5, 164/150, 154, 155, 412, 167, 269, 32

[56] References Cited

FOREIGN PATENT DOCUMENTS 2804705 8/1978 Fed. Rep. of Germany ..... 164/154
2471240 6/1981 France ..... 164/154
63-268562 11/1988 Japan ..... 164/457
64-66065 3/1989 Japan ..... 164/457
WO81/00976 4/1981 World Int. Prop. O. ..... 164/457

*Primary Examiner*—Kuang Y. Lin
*Attorney, Agent, or Firm*—Larson & Taylor

[57] ABSTRACT

In an automatic foundry plant were the molds are made in a molding station (11), and the metal is poured into the molds while these are in a pouring station (21), information concerning the characteristics of the individual molds is sensed from the molds in the molding station (11), and possibly also in a core setter (13). This information is recorded by parameter recording units and control signals based thereon are transmitted to the pouring station (21), and used in controlling the function of the latter at the time when the mold to which the information in question relates is in the pouring station (21). This arrangement prevents, without human surveillance, the occurrence of faulty operations such as pouring of casting metal outside the mold or pouring into defective molds. The requisite control equipment can also be used, for example, in providing the individual molds with marks corresponding to the batch that has been used, so that castings from a faulty batch can be sorted out, for example, by being delivered to a station (47) provided for this purpose.

4 Claims, 1 Drawing Sheet

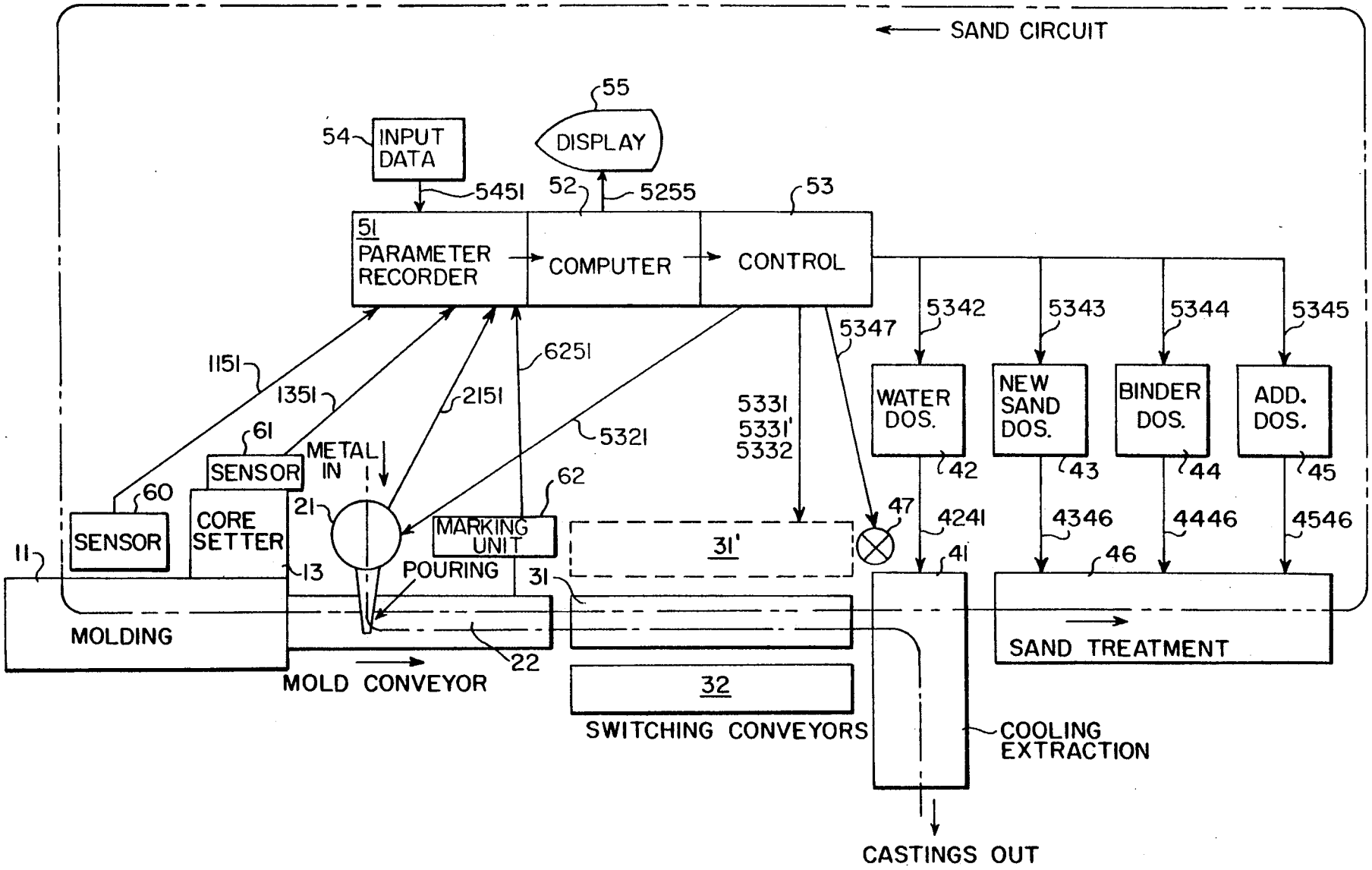
SAND CIRCUIT
ADD. DOS.
BINDER DOS.
NEW SAND DOS.
WATER DOS.
SAND TREATMENT
COOLING EXTRACTION
CASTINGS OUT
CONTROL
COMPUTER
DISPLAY
INPUT DATA
PARAMETER RECORDER
MARKING UNIT
POURING
SWITCHING CONVEYORS
MOLD CONVEYOR
METAL IN
SENSOR
CORE SETTER
SENSOR
MOLDING
5345
5344
5343
5342
45
44
43
42
4546
4446
4346
4241
46
41
47
5347
53
5331
5331'
5332
31'
32
5255
55
52
5321
6251
62
31
22
5451
2151
54
51
1351
1151
61
21
13
60
11

AUTOMATIC FOUNDRY PLANT

This application is a continuation of application Ser. No. 07/525,705, filed May 21, 1990, now abandoned.

The present invention relates to an automatic foundry plant of the kind discussed in more detail below and also set forth in claim 1.

In previously known plant of this character it has—in spite of the designation "automatic"—been necessary to some degree to supervise the pouring station in order to prevent the occurrence of faulty operations in this station that might lead to interruptions of the operation. As even brief interruptions may in plant of this type have very serious consequences, and as human supervision is not fully reliable, there is a need of automatic control of the pouring station with a view to preventing fault functions. Such faulty operations may for instance result to, due to incorrect alignment of the inlet (gate) of a mold and the metal outlet of the pouring station, the molten metal running partly or totally outside the mold and down on the mold conveyor, or where mold is defective, for example by missing one or several cores, can result in making the casting unusable for its purpose.

The object of the present invention is to provide an automatic foundry plant of the kind referred to initially, in which the functions of the pouring station are automatically controlled in such a manner that the risk of faulty operations of the above type or other types are considerably reduced, and this object is achieved by a foundry plant which according to the present invention is also designed and arranged as set forth in claim 1.

Hereby it is achieved that the plant itself records information about the individual molds and uses this information in controlling the pouring station at the exact time when the mold being the subject of the information is positioned in the pouring station.

By the exemplary embodiment set forth in claim 2 it is avoided that metal is poured down on the mold conveyor or the foundry floor, with the resulting serious consequences.

By using the exemplary embodiment described in claim 3 it is achieved that the casting metal is poured into the appointed inlet in the mold. It should be noted that the position of this inlet may vary from one type of mold to the next, but by letting the parameter recording units record information also about the type of mold, it can be ensured that the pouring is done correctly also in case of changes from one type of mold to another.

When in the pouring station a new batch of molten metal is poured, it may happen as a consequence of the high working rate of the plant, that a number of molds are poured before the result of the sample taken of the new batch is available. If it then proves that the batch does not have the desired composition, the castings in question must be scrapped. This is easily achieved by means of the exemplary embodiment described in claim 4, by which it is achieved that each individual mold is given a mark for identification of the batch in question.

The identification marks can be used for sorting out the molds containing castings of an undesired composition be means of the exemplary embodiment set forth in claim 5.

Obviously it is not impossible to connect the parameter recording means with the control means by means of conventional wires, relays, etc., but as the parameter signals sent to the parameter recording units contain information about many different conditions, it is preferable to use modern information technology for the implementation of the functions in question. Not least it is hereby made possible to store the information relating to each individual mold, which information is for most molds generated in the molding and preparation station, until the time when the mold has arrived at the pouring station, and this information is therefore relevant to the pouring station at exactly this time. The exemplary embodiment set forth in claim 6 represents this solution.

By using the exemplary embodiment set forth in claim 7 it is achieved that it is no longer necessary to place the identification marks direct on the molds, where they may be very vulnerable, but the marks may instead be placed in the information signal group or data entry in question.

The present invention will in the following be explained in more detail with reference to the drawing which is a block diagram of an exemplary embodiment of an automatic foundry plant, such as the plant could be imagined to be used for casting objects of iron or iron alloys in molds of molding sand, produced before the individual pourings, and after this crushed with a view to re-use of the molding sand.

The exemplary embodiment shown in the drawing of an automatic foundry plant according to the present invention has been drawn as highly simplified as possible in order to facilitate the understanding of the control processes being the subject of the present invention.

This part of the plant includes a molding station 11, in which suitable mold material, such as molding sand, is molded into mold sections. These mold sections are delivered from the molding station 11 to a mold conveyor 22. A core setter 13 is used to place cores in the molds made in the molding station 11, before the molds are delivered to the mold conveyor 22. The mold conveyor 22 conveys the molds from the molding station 11 through a pouring station 21. The pouring station 21 provides for pouring of molten metal in a known manner into the mold, which are then moved with their content of poured metal by the mold conveyor 12 onto a set of switching conveyors 31 and 32.

The set of switching conveyors 31 and 32, in addition to being able to convey the molds onwards in the same direction, are also adapted to be switched sideways in such a manner that either the conveyor 31 or the conveyor 32 is placed in alignment with, so as to provide a continuation of, the mold conveyor 22. This is done in order to prolong the duration of the stay of the molds and to thus increase the resulting cooling during the time from the arrival of the molds from the mold conveyor 22 to their delivery to an extraction station 41.

At the extraction station 41 the castings are separated from the molds and any cores, by, for example, being tumbled in a drum, preferably with water dosing in order to bind dust, in order to obtain further cooling and to produce, in addition, a suitable water content in the molding sand produced at extraction.

A sand processing station 46 provides treating of the molding sand for the purpose of re-use in the molding station 11, by, for example adding new molding sand, bentonite, carbon powder and/or other binders and/or additives.

As indicated by the drawing the cooled and extracted castings are taken out of the extraction station 41 at its end shown lowermost in the drawing. In the drawing, the flow of the metal through the pouring station 21, the mold conveyor 22, the switching conveyor 31, and the extraction station 41 is shown by a line with one dot between the dashes, whereas the molding sand flow through the molding station 11, the mold conveyor 22, the switching conveyor 31, the extraction station 41, and the sand treatment station 46 is shown by a line with two dots between the dashes.

In addition to the units mentioned, the plant may comprise a sorting station 47, which is indicated as "a hole in the floor" at the delivery end of the switching conveyor 31, when the latter is in position 31' shown in broken lines. The sorting station 47 can be used for sorting out molds with or without cast metal in them, which for some reason are not required to be delivered to the extraction station 41.

In addition, the plant shown comprises dosing units for water, new molding sand, binder, etc. in the form of a water dosing unit 42, which is adapted to supply water through a water dosing pipe 4241 to the extraction station 41 (as it will appear from the drawing, the reference numerals for the pipes or lines connecting the various units have the first two digits identical to the reference FIGURE of the unit from which the operation or flow concerned originates, whereas the last two digits consist of the reference numeral of the unit receiving the flow or function concerned), a new sand dosing unit 43, which is adapted to supply fresh molding sand through a new sand pipe 4346 to the sand processing unit 46, a binder dosing unit 44, which is adapted to supply binder through a binder pipe 4446 to the sand processing unit 46, and an additive dosing unit 45, which is adapted to supply further additives through an additive line 4546 to the sand processing station 46, All dosing units 42–45 are adapted to be controlled by a control unit 53, which is adapted to control the functioning of the individual dosing units through the respective control lines 5342-45, as it will be explained below.

The equipment, with which the automatic control functions comprised by the present invention are executed, includes, apart from sensors, control converters, etc. not shown in or at the various stations or units, a parameter recording unit 51, a computing unit 52, the above mentioned control unit 53, an input data unit 54 and a data display unit 55.

The units 51–55 can in manner known in principle be incorporated in a computer with display, keyboard, etc., in which the various functions here described may be more or less integrated in the hardware, or they may be divided in a manner different from the one described here, without this producing any change in the overall operation.

The parameter recording unit 51 can receive input data in the form of signals from the molding station 11 through a parameter line 1151, the core setter 13 through a parameter line 1351, the pouring station 21 through a parameter line 2151, and from the input data unit 54 through a data input line 5451.

In addition, the parameter recording unit 51 is adapted to emit signals in the form of output data to the computing unit 52.

The computing unit 52 is adapted as indicated above to receive input data signals from the parameter recording unit 51, to emit output data in the form of multiple control signals to the control unit 53, and to emit suitable operator data through a data line 5255 to the data display unit 55.

The control unit 53 is adapted to as mentioned above to receive multiple control signals from the computing unit 52, and to emit control signals as follows:

through a control line 5321 to the pouring station 21, via one or several control lines 5331,5332 and possibly 5331' to the switching conveyors 31 and 32, via a control line 5347 to the sorting station 47, via the control line 5342 to the water dosing unit 42, via the control line 5343 to the new sand dosing unit 43, via the control line 5344 to the binder dosing unit 44, and via the control line 5345 to the additive dosing unit 45.

The plant can, of course, comprise a number of parameter and/or control lines or wires not shown, relating to other functions than those dealt with by the present invention.

CONTROL OF POURING STATION

In order to obtain optimum casting in the pouring station 21 it is necessary that the signals used for controlling this station should as a minimum contain data with information about the type of mold at that moment arriving from the molding station 11, whether the core setter 13 has placed the requisite cores in the mold in question, whether the mold has the requisite firmness to withstand pouring, and whether the mold should be unsuitable for pouring for other reasons than lack of firmness.

By means of sensors (not shown) in the molding station 11 and the core setter 13, signals are generated corresponding to the data mentioned, and these signals are transmitted via the parameter lines 1151 and 1351 respectively to the parameter recording unit 51. The data related to an individual mold are collected in a data record, which by means of suitable circuits and/or programs in the units 51,52 and possibly 53 are made to "follow" the individual molds on their way through the plant from the molding station 11 to the extraction station 41.

The above data, which have been received by the parameter recording unit 51, are transmitted to the computing unit 52, in which they are transformed into the multiple control signals mentioned above, which are transmitted to the control unit 53, which on the basis of those part-data relating to the control of the pouring station 21, control the function of this station through the control line 5321.

This control may comprise for example, that the outlet for molten metal in the pouring station 21 is moved to a position corresponding to the computed position of the inlet (gate) of the mold at that moment placed under the outlet, that if the data in question contain information that a required core has not been set, that the mold does not show the requisite firmness, and/or that the mold is in some way incomplete, the molten metal outlet in the pouring station 21 is blocked, so that there will not be poured into the mold in question.

The operator may also, if one or several molds bear visible signs of being unsuitable for pouring, block the metal outlet in the pouring station 21 by suitable manual intervention at the input data unit 54.

The individual data records generated at the production and preparation of the individual molds in the molding station 11 and possibly by means of the core setter 13, can suitably be recorded in a register of the "FIFO" buffer type, in which the whole queue is shifted one step forward each time a new data record is entered, when at various positions along the queue data is read out and/or in from and to the various stations and other controlled units respectively. In this manner the various stations and other controlled units can receive the various data at the exact time when the mold or material in question is placed in or is passing them.

In the parameter recording unit data can be read in, for example via the input data unit 54, with information about for example the metal alloy batch being used at the moment in the pouring station 21. In such case it may contain means for providing each mold with a mark corresponding to this information, so that further downstream in the plant it can be ascertained from which batch the casting in question originates. The mark can be made on the mold itself by a marking unit indicated schematically at 62 as a visible or machine-readable mark (for example in bar code), but instead of this, or in addition to this, it can be placed in the data record relating to the mold in question with a view to use further downstream in the plant, for example for using the sorting station 47 to reject molds with cast metal that have been made from a batch that by laboratory tests of a sample taken has proved to be unsuitable for the purpose. Marking unit 62 is connected by line 6251 to parameter recorder 51.

CONTROL OF SWITCH CONVEYORS

In order to allow the molds, in which metal has been poured at the pouring station 21, to cool off sufficiently before they are moved into the extraction station 41, a certain time must pass. However, the speeds at which the molds are conveyed to, through and from the pouring station are so high, that if these molds were to be conveyed in a straight path from the extraction station 41, it would require a conveyor length that may be difficult or impossible to find in an existing foundry hall. In order to reduce the total length of the plant, the conveyor distance from the pouring station 21 to the extractor station 41 has therefore partly been split up into several, and in the case shown two, sidewise switching conveyors 31 and 32, which have been arranged so that if the conveyor being in line with the mold conveyor 22 has been filled up, it is replaced by the other conveyor and at the same time stopped, the other conveyor being started at the same time. In this manner the molds standing on the "shunted-out" switching conveyor will have time to cool off, while new molds are being fed to the other conveyor now placed in line with the mold conveyor 22. When the other conveyor has been filled (or possibly sooner), the conveyors are switched back, so that the cooled molds on the first mentioned conveyor are transferred to the extraction station, and new, hot molds from the mold conveyor are entered after them.

Previously, this switching between the various switching conveyors has been controlled manually or semi-automatically, with the result that implying in practice that pouring must be omitted in a number of molds which at the time of switching are placed near the transition between the mold conveyor 22 and the related switching conveyor 31 or 32. This will obviously involve a not inconsiderable waste of molding sand and—not least—productive time. This problem has been solved by the computing unit 52, on the basis of data relating to the summated dimension of the molds in the direction of travel, deciding a suitable time for the switching conveyors 31 and 32 to move sidewise without any molds being present at the transition location itself. The control required for this takes place via the control unit 53 and the control lines 5331 and 5332 to the switching conveyors 31 and 32.

For several reasons it may be desirable before moving the switching conveyors sideways to create a certain interspace between the mold standing at the output end of the mold conveyor 22 and the mold standing at the input end of the switching conveyor 31 or 32 as the case may be. Especially in cases where the individual molds produced in the molding station 11 are not independent molds, but have each a rearwardly facing mold half matching a forwardly facing mold half on the next mold block for formation of the mold cavity, it is in many cases quite necessary to create an interspace as mentioned. In such cases there is a corresponding control function to make the core setter 13 omit setting cores, and the pouring station to omit pouring into the mold cavity that is made unsuitable for pouring in this manner. All this is, of course, possible by data input and output to and from the data records corresponding to the molds in question when these are situated in positions in the queue corresponding to the stations in question, respectively the transition region between the mold conveyor 22 and the switching conveyor 31 or 32.

CONTROL OF DOSING UNITS

As mentioned above, the water dosing unit 42 adapted to be controlled by the control unit 53 to dose a volume of water suitable at any time to the extraction station 41 in order to ensure that the molding sand leaving the extraction station 41 in transit to the sand treatment station 46 and from there back to the molding station 11 has the correct water content. The importance of this is known by foundry specialists. In addition, and as mentioned above, the dosing units 43–45 are adapted to be controlled by the control unit 53 to supply fresh molding sand, binder and additives, respectively, to the sand processing station 46, in which the constituents now added are mixed with the "old" molding sand, and finally returned to the molding station 11 for the purpose of being re-used for making new molds.

The new molds made in the molding station 11 will therefore, in addition to the original molding sand, contain a certain amount of water and certain amounts of new molding sand, binder and additives, respectively, which are all necessary, partly to replace lost molding sand, partly to make the mold sufficiently firm, and partly to influence the process taking place when the molten metal contacts the walls of the mold cavity, for example for the purpose of influencing the surface of the castings or obtaining good parting or release properties.

The heat imparted to the mold by the poured metal will, of course, cause a certain proportion of water to evaporate, while this evaporation will not take place in cases where for some reason—see above—no metal is poured into the mold cavity in question.

In order to ensure that the amount of water dosed into the extraction unit 41 at any time corresponds as closely as possible to the actual need, the pouring station 21 therefore sends information through the parameter line 2151 of firstly, whether the mold in question has been poured, and secondly, such other parameters as the weight of the mold, the weight and temperature of the poured metal, etc.

This information will then, in a similar manner as described above, be incorporated in the data record associated with the mold in question, which record, when arriving at the place in the "queue" corresponding to the extraction station 41, will suitably instruct the water dosing unit 42. Also this control procedure can of course be influenced by input of suitable data through the input data unit 54.

The control of the dosing units 43–45 can take place in a similar manner and to the extent to which it is possible to sense the parameters of importance to the various dosings. To the extent that such parameter sensing is impossible, this control must be carried out empirically, for example by making laboratory tests of molding sand samples at some point in the sand circuit form the basis of control data, which again are fed into the input data unit 54. It is obvious, however, that especially the dosing of binder (dosing unit 44) and additives (dosing unit 45) will depend on the amount of molding sand being used for each mold, for which reason the relevant data from the molding station 11 can suitably be used in controlling these dosings.

In accordance with an important embodiment of the invention the parameter recording unit 51 is adapted to transform the recorded parameters into information signal groups, for example, in the form of data records, each of which is associated by the computing unit 52 with the individual molds to which the parameters in question relate, and the control units associated with the work stations of the system are adapted to use the parameter signals contained in the information groups as control signals.

I claim:

1. In an automatic foundry plant for carrying out a casting process, said plant comprising:

a plurality of work stations;

at least one conveyor for conveying materials used in the casting process including raw materials, molds and cores, and castings produced by the casting process to, between and from said work stations;

parameter recording means, associated with at least a first work station, for recording parameters relating to each mold and for producing an output in accordance with the recorded parameters;

at least one marking device;

control means, associated with at least a second work station located downstream from said first work station, for receiving said output from said parameter recording means, for, in dependence upon the parameters of the output received, controlling at least one of the operations of the second work station during the period when the mold to which said parameters are related is at the second work station, and for inducing said at least one marking device to provide each mold with a mark relating to information with regard to the subsequent treatment or handling of the mold; and sorting means, located downstream from the first work station, for separating from the other molds, molds having at least one selected mark.

2. A foundry plant according to claim 1 wherein said parameter recording means comprises means for transforming the recorded parameters into information signal groups comprising corresponding parameter signals which are associated with the individual molds to which the recorded parameters of the information signal groups pertain, wherein the control means use the parameter signals contained in the information signal groups as control signals, and wherein the parameter recording means further provides that the at least one mark with which each individual mold is associated is included as a mold identification signal in the information signal group associated with the mold in question.

3. A foundry plant according to claim 2 wherein said conveyors comprise transversely shiftable switching conveyors each having an output end and wherein at least one of the switching conveyors is controlled by the control means to be movable, in use, to a position in which the output end thereof faces a separating station for receiving molds having at least one predetermined mark indicating that said molds are to be delivered to said separating station.

4. A foundry plant according to claim 2 wherein said conveyors comprise transversely shiftable switching conveyors each having an output end and wherein at least one of the switching conveyors is controlled by the control means to be movable, in use, to a position in which the output end thereof faces a separating station for receiving molds based on an associated said mold identification signal containing information that said molds are to be delivered to said separating station.

* * * * *